US007874409B1

(12) United States Patent
Lakhal

(10) Patent No.: US 7,874,409 B1
(45) Date of Patent: Jan. 25, 2011

(54) EXPANDABLE SUITCASE

(76) Inventor: Imad Lakhal, 5441 NE. River Rd., Chicago, IL (US) 60656

( * ) Notice: Subject to any disclaimer, the term of this patent is extended or adjusted under 35 U.S.C. 154(b) by 649 days.

(21) Appl. No.: 11/874,992

(22) Filed: Oct. 19, 2007

(51) Int. Cl.
*A45C 7/00* (2006.01)

(52) U.S. Cl. ..... 190/105; 190/18 A; 190/115; 190/103

(58) Field of Classification Search ..... 190/103, 190/104, 105, 127, 18 A, 37; 220/9.1, 9.2, 220/9.3, 9.4, 8
See application file for complete search history.

(56) References Cited

U.S. PATENT DOCUMENTS 2,907,487 A * 10/1959 Harrington ..... 220/8
3,504,772 A * 4/1970 Barry ..... 190/105
3,513,952 A * 5/1970 Warner, Jr ..... 16/113.1
4,004,664 A * 1/1977 Pelavin et al. ..... 190/127
4,007,664 A * 2/1977 Popp ..... 91/49
4,846,319 A * 7/1989 Sadow ..... 190/105
5,472,082 A * 12/1995 Thiele ..... 190/105

* cited by examiner

*Primary Examiner*—Tri M Mai

(57) ABSTRACT

An expandable suitcase. An illustrative embodiment of the expandable suitcase includes an enclosure comprising a length-adjustable and width-adjustable enclosure frame; a pair of expandable end panels, a pair of expandable side panels and an expandable bottom panel provided on the enclosure frame; a lid comprising a length-adjustable and width-adjustable lid frame pivotally carried by the enclosure frame; and an expandable lid panel provided on the lid frame.

5 Claims, 6 Drawing Sheets

EXPANDABLE SUITCASE

FIELD

The present disclosure relates to luggage. More particularly, the present invention relates to an expandable suitcase the volume of which can be selectively increased or decreased depending on carrying needs.

BACKGROUND

Luggage is available in a variety of sizes. Typically, a multi-piece luggage set includes multiple suitcases ranging in size from small to large. When travel needs arise, the suitcase which is selected depends typically on the quantity of luggage which is to be carried. However, storage of multiple pieces of luggage requires a large volume of space.

SUMMARY

The present disclosure is generally directed to an expandable suitcase. An illustrative embodiment of the expandable suitcase includes an enclosure comprising a length-adjustable and width-adjustable enclosure frame; a pair of expandable end panels, a pair of expandable side panels and an expandable bottom panel provided on the enclosure frame; a lid comprising a length-adjustable and width-adjustable lid frame pivotally carried by the enclosure frame; and an expandable lid panel provided on the lid frame.

DETAILED DESCRIPTION

Figure 1:
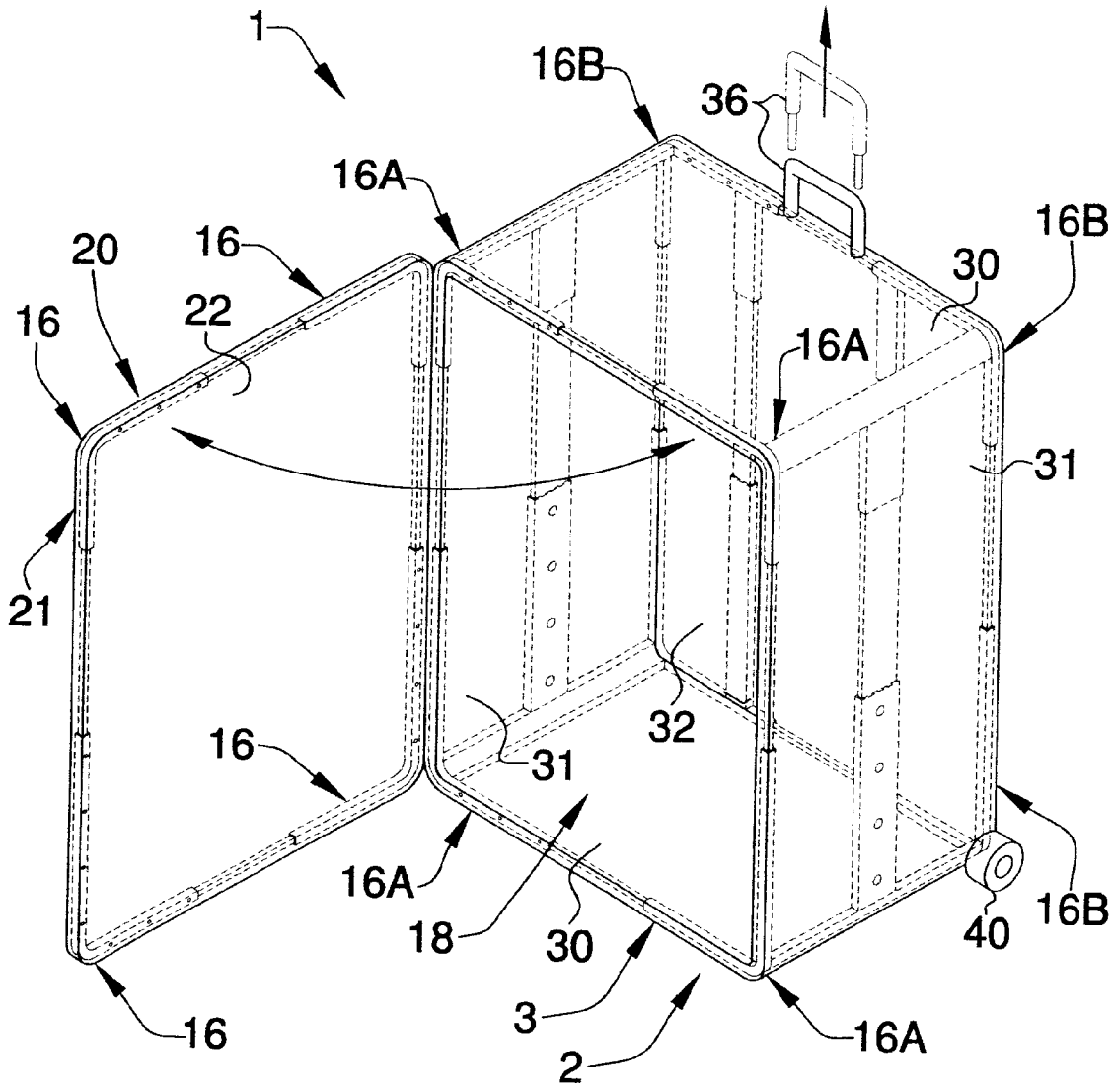
FIG. 1 is a front perspective view of an illustrative embodiment of the expandable suitcase, shown in an open configuration.

Referring to the drawings, an illustrative embodiment of the expandable suitcase is generally indicated by reference numeral 1 in FIG. 1. The expandable suitcase 1 includes a generally rectangular enclosure 2 and a generally rectangular lid 20 which is pivotally attached to the enclosure 2. As will be hereinafter described, the volume of the enclosure 2, as well as the length and width of the lid 20, can be selectively adjusted depending on the carrying requirements of the expandable suitcase 1.

Figure 2:
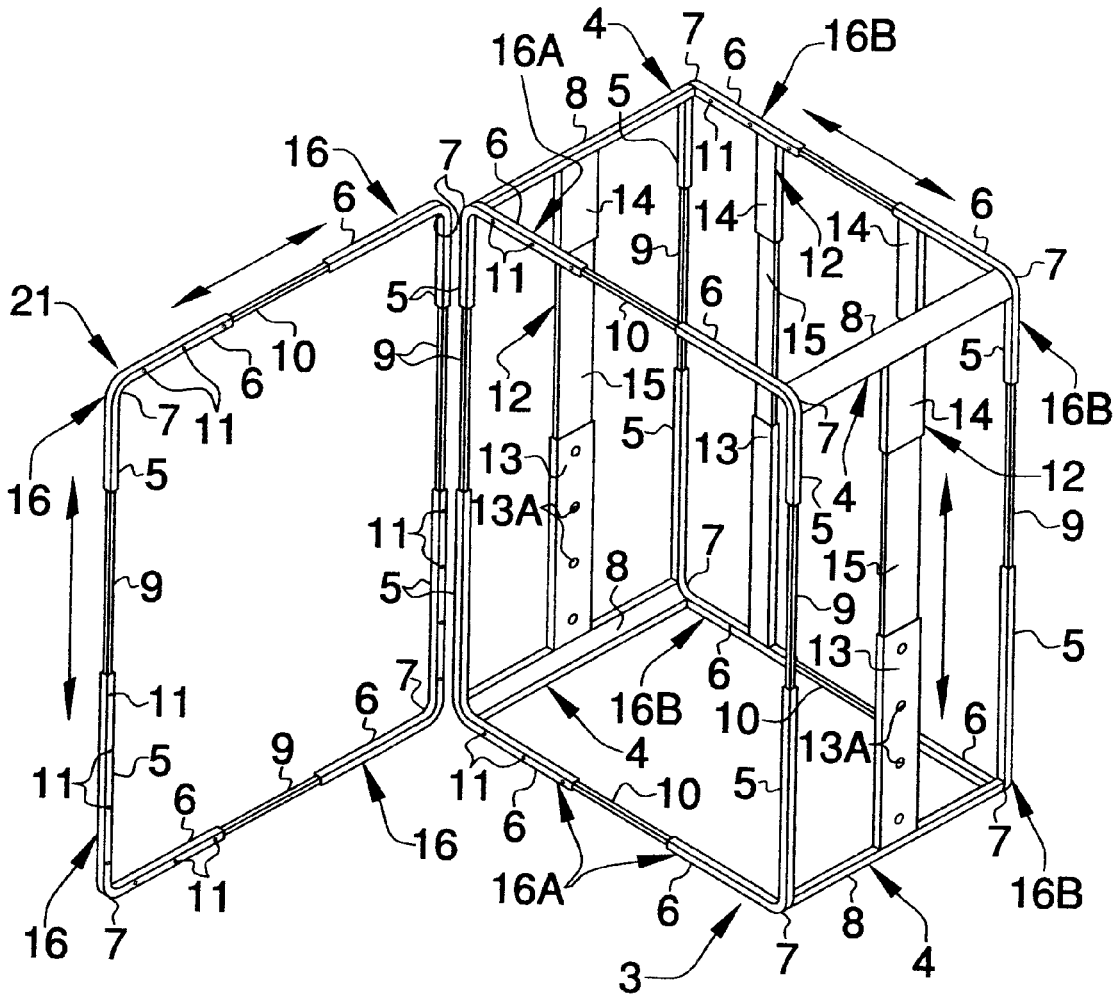
FIG. 2 is a front perspective view of enclosure frame and lid frame elements of an illustrative embodiment of the expandable suitcase, shown in an open configuration.

As shown in FIG. 2, the enclosure frame 2 of the expandable suitcase 1 includes an enclosure frame 3 having four corner members 4 which define the respective corners of the enclosure frame 3. Each corner member 4 of the enclosure frame 3 includes a generally elongated corner connecting member 8. A pair of generally L-shaped corner pieces 16*a*, 16*b* is provided on the respective ends of the corner connecting member 8. Each corner piece 16*a*, 16*b* may include a side segment 5, an end segment 6 which is disposed in generally perpendicular relationship with respect to the side segment 5 and a corner segment 7 which connects the side segment 5 and the end segment 6 to each other. The corner segment 7 of each corner piece 16 is attached to the corresponding end of the corner connecting member 8 according to the knowledge of those skilled in the art. Alternatively, the corner segment 7 of each corner piece 16 may be formed integrally with the corner connecting member 8. Accordingly, four of the corner pieces 16*a* lie in a common plane which defines the opening of the enclosure 2. The remaining four corner pieces 16*b* lie in a common plane which is spaced-apart with respect to the plane which is defined by the corner pieces 16*a*.

The side segments 5 of adjacent corner pieces 16 which lie in the same plane are connected by a generally elongated side connecting member 9. In similar manner, the end segments 6 of adjacent corner pieces 16 which lie in the same plane are connected by a generally elongated end connecting member 10. Each side connecting member 9 may be telescopically extendable with respect to the side segments 5 and each end connecting member 10 may be telescopically extendable with respect to the end segments 6. Therefore, the side segments 5 can be moved toward and away from each other along the side connecting member 9 and the end segments 6 can be moved toward and away from each other along the end connecting member 10. As shown in FIG. 1, wheels 40 may be provided on a pair of the corner members 16*b*. An extendable handle 36 may be provided on the enclosure frame 3.

Figure 6:
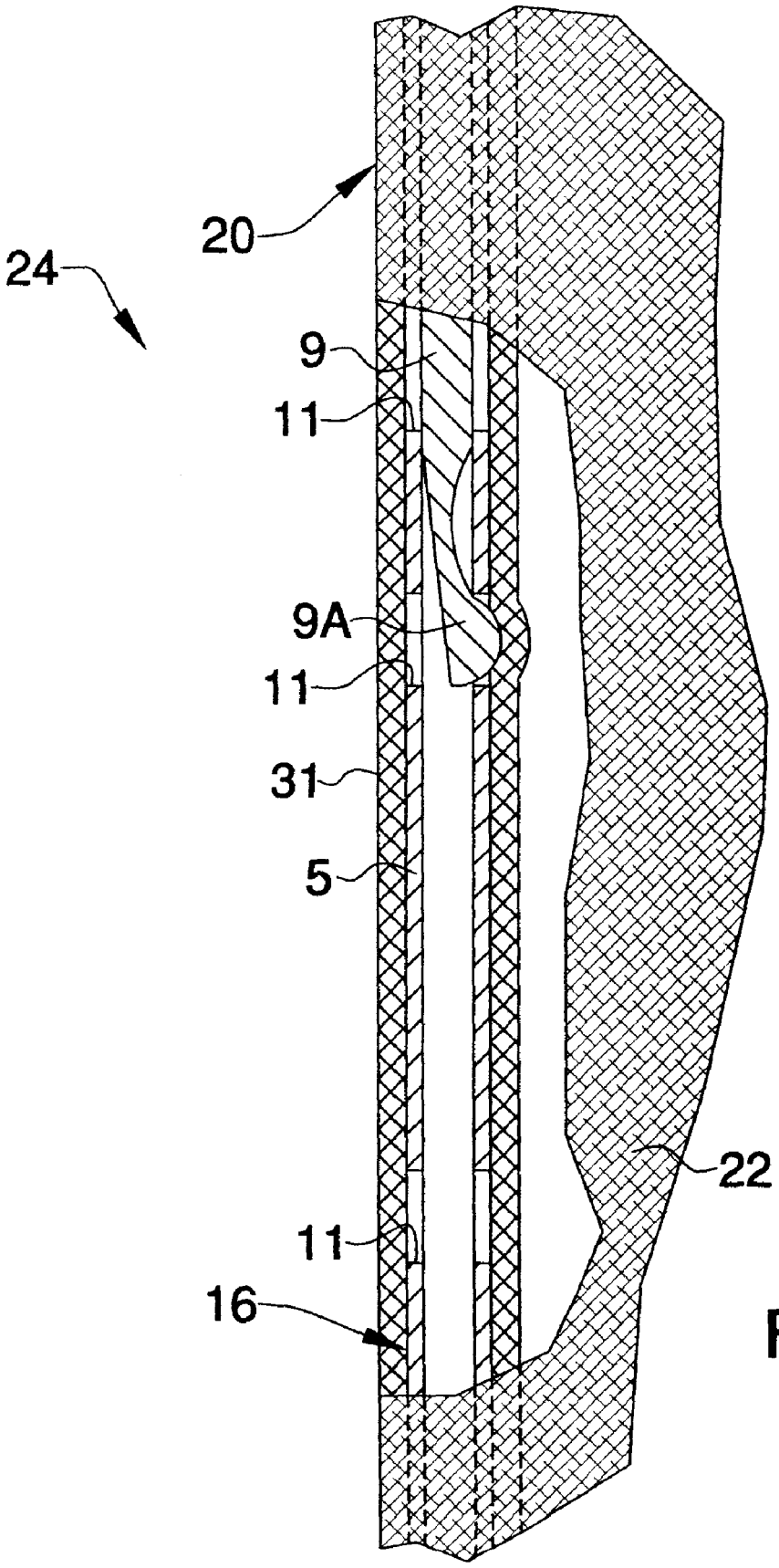
FIG. 6 is a sectional view illustrating an exemplary adjustment pin technique for adjusting the size of the enclosure and lid elements of the expandable suitcase.

A lock mechanism 24 facilitates selective locking of each side segment 5 with respect to the corresponding side connecting member 9 and each end segment 6 with respect to the corresponding end connecting member 10. Accordingly, as shown in FIG. 6, in some embodiments the lock mechanism 24 includes multiple, spaced-apart lock pin openings 11 provided in each side segment 5 and each end segment 6 of each corner piece 16. A flexible lock pin 9*a* is provided in each end of each side connecting member 9, as shown in FIG. 9, and each end of each end connecting member 10. The lock pin 9*a* seats in a selected one of the lock pin openings 11 depending on the degree of insertion or extension of the side connecting member 9 in the corresponding side segment 5 or end segment 6. The lock pin 9*a* can be pushed through and disengaged from the lock pin opening and to facilitate sliding of the lock pin 9*a* in the side segment 5 or end segment 6 to facilitate volume adjustment of the enclosure frame 3.

Multiple length-adjustable frame stabilizing members may extend between the corner members 4, along respective sides of the enclosure frame 3. Each frame stabilizing member may include, for example, a base portion 13 which extends from a corner connecting member 8 of one corner member 4 and an attachment portion 14 which extends from a corner connecting member 8 of an adjacent corner member 4. A generally elongated insertion portion 15 extends from the attachment portion 14 and is inserted in the base portion 13. Multiple, spaced-apart adjustment openings 13*a* may be provided in the base portion 13. A flexible lock pin (not shown), such as the lock pin 9*a* (FIG. 6) which extends from the side connecting member 9, may extend from the insertion portion 15 for seating in a selected one of the adjustment openings 13*a* depending on the selected length of the enclosure frame 3.

As shown in FIG. 1, end panels 30 and side panels 31 extend between the adjacent corner members 4 of the enclosure frame 3. A bottom panel 32 extends between the corner pieces 16*b* of the respective corner members 4. Each of the end panels 30, the side panels 31 and the bottom panel 32 may be any type of expandable and retractable material. The end panels 30, side panels 31 and bottom panel 32 define an enclosure interior 18.

As further shown in FIG. 2, the lid 20 (FIG. 1) of the expandable suitcase 1 may include a generally elongated, rectangular lid frame 21 which is pivotally attached to the enclosure frame 3 of the enclosure 2 according to the knowledge of those skilled in the art. The lid frame 21 may include four corner pieces 16 which define respective corners of the lid frame 21 and which lie in substantially the same plane. Each corner piece 16 includes a side segment 5 and an end segment 6 which are generally perpendicular to each other and connected by a corner segment 7. Side connecting members 9 connect the side segments 5 to each other and end connecting members 10 connect the end segments 6 to each other, as was heretofore described with respect to the enclosure frame 3 of the enclosure 2. As shown in FIG. 1, a lid panel 22 extends between the corner pieces 16 of the lid frame 21 of the lid 20. The lid panel 22 may be any type of expandable and retractable material.

Figure 3:
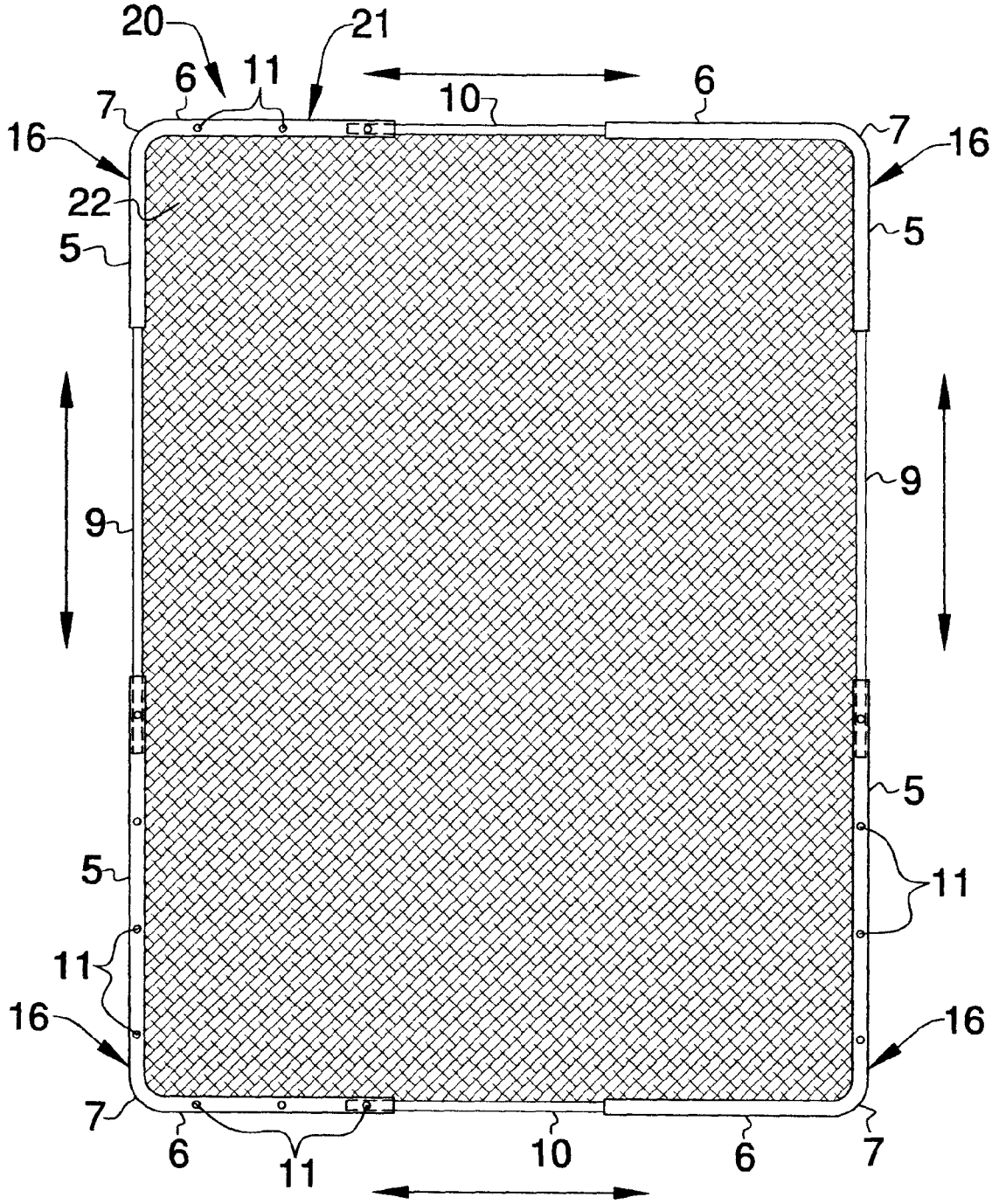
FIG. 3 is a front view a lid element of an illustrative embodiment of the expandable suitcase, more particularly illustrating lengthwise and widthwise adjustment of the lid.
Figure 4:
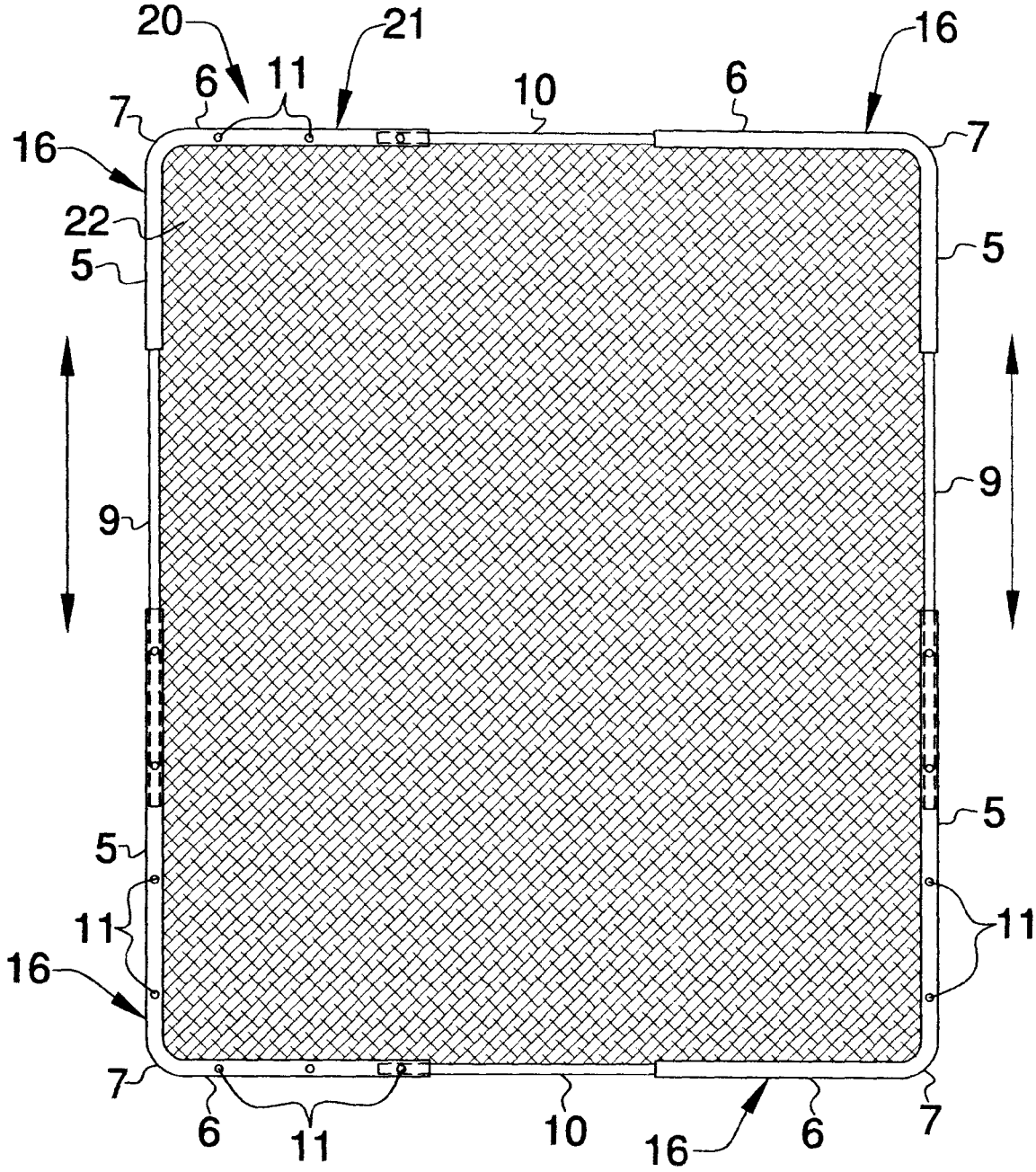
FIG. 4 is a front view of a lid element of an illustrative embodiment of the expandable suitcase, more particularly illustrating lengthwise adjustment of the lid.
Figure 5:
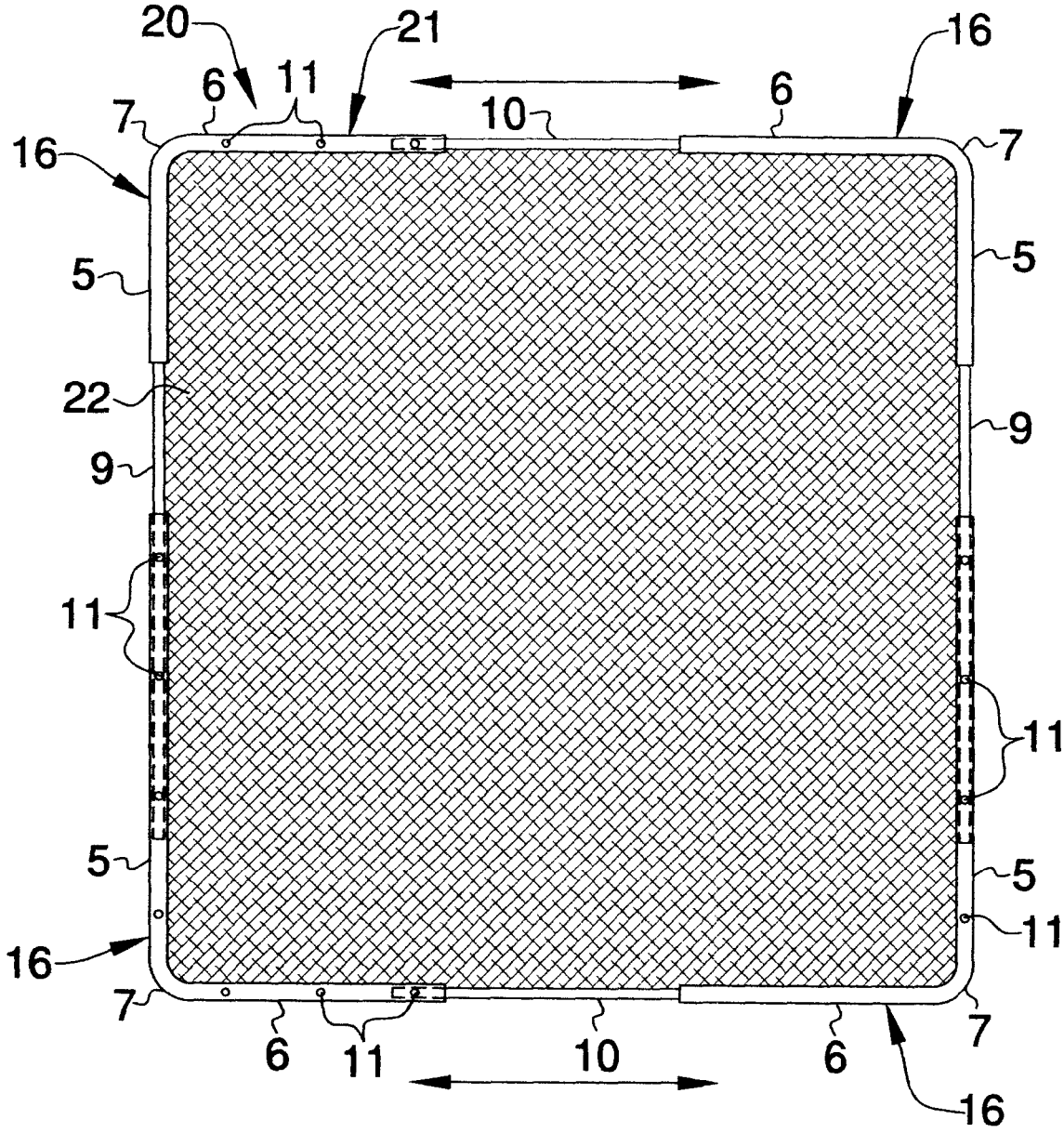
FIG. 5 is a front view of a lid element of an illustrative embodiment of the expandable suitcase, more particularly illustrating widthwise adjustment of the lid.

In typical use, the enclosure 2 is adjusted in volume and the lid 20 is adjusted in size depending on the carrying needs of the expandable suitcase 1. As shown in FIGS. 3 and 4, the lid 20 is adjusted in length by sliding the side segment 5 of each corner member 16 along the corresponding side connecting member 9 which extends there between. In similar manner, the lid 20 is adjusted in width by sliding the end segment 6 of each corner member 16 along the corresponding end connecting member which extends there between, as shown in FIGS. 3 and 5. The length and width, and therefore the volume, of the enclosure 2 are adjusted in similar manner to match the size of the lid 20. The lid 20 and the enclosure 2 are locked in the desired size typically by engagement of the lock mechanism 24 which was heretofore described with respect to FIG. 6.

After the volume of the enclosure 2 and the size of the lid 20 are selected, items (not shown) such as clothing and the like are placed in the enclosure interior 18 (FIG. 1) of the enclosure 2. The lid 20 is pivoted to a closed position on the enclosure 2 and sealed. Accordingly, a zipper (not shown) may be provided to facilitate sealing of the lid 20 on the enclosure 2, typically in the conventional manner. The expandable suitcase 1 may be transported by pulling the handle 36 and rolling the expandable suitcase 1 on the wheels 40.

While the illustrative embodiments of the disclosure have been described above, it will be recognized and understood that various modifications can be made to the embodiments and the appended claims are intended to cover all such modifications which may fall within the spirit and scope of the disclosure.

What is claimed is:

1. An expandable suitcase, comprising:

an enclosure comprising a length-adjustable and width-adjustable enclosure frame;

a pair of expandable end panels, a pair of expandable side panels and an expandable bottom panel provided on said enclosure frame;

a lid comprising a length-adjustable and width-adjustable lid frame pivotally carried by said enclosure frame;

an expandable lid panel provided on said lid frame; said expandable end panels, side panels, bottom panel and lid panel are formed of an expandable and retractable material;

an extendable handle provided on said enclosure frame; and at least one wheel provided on said enclosure frame.

2. The expandable suitcase of claim 1 wherein said enclosure frame comprises plurality of corner members and wherein adjacent ones of said plurality of corner members are spatially adjustable with respect to each other.

3. The expandable suitcase of claim 2 further comprising at least one connecting member connecting said adjacent ones of said plurality of corner members to each other.

4. The expandable suitcase of claim 3 wherein each of said corner members comprises a pair of generally L-shaped corner pieces and wherein said at least one connecting member connects said corner pieces of adjacent ones of said plurality of corner members to each other.

5. The expandable suitcase of claim 1 wherein said lid frame comprises a plurality of generally L-shaped corner pieces spatially adjustable with respect to each other.

* * * * *